10/15/85 4,547,269

United States Patent [19]

Raüsch et al.

[11] Patent Number: 4,547,269

[45] Date of Patent: Oct. 15, 1985

[54] METHOD OF ELECTRODEPOSITING ZINC ON STEEL PRIOR TO PHOSPHATING

[75] Inventors: Werner Raüsch, Oberursel; Gerhard Müller, Hanau am Main, both of Fed. Rep. of Germany

[73] Assignee: Metallgesellschaft Aktiengesellschaft, Frankfurt, Fed. Rep. of Germany

[21] Appl. No.: 653,504

[22] Filed: Sep. 21, 1984

[30] Foreign Application Priority Data

Sep. 28, 1983 [DE] Fed. Rep. of Germany ..... 3335009

[51] Int. Cl.[4] ..... C25D 3/22; C25D 5/48

[52] U.S. Cl. ..... 204/34; 204/38.1; 204/55 R

[58] Field of Search ..... 204/55 R, 38.1, 34; 148/6.15 R, 6.15 Z

[56] References Cited

U.S. PATENT DOCUMENTS 1,017,981 2/1912 Lemêtre ..... 204/55 R
1,607,869 11/1926 Colcord ..... 204/55 R
3,713,092 1/1973 Vrijburg et al. ..... 148/6.15 Z

OTHER PUBLICATIONS

Ernest H. Lyons, Jr., The Electrochemical Soc., vol. 80, pp. 387–398, (1941).

*Primary Examiner*—G. L. Kaplan
*Attorney, Agent, or Firm*—Karl F. Ross; Herbert Dubno

[57] ABSTRACT

A process of electrodepositing zinc on steel wherein zinc-containing aqueous sulfuric acid electrolytes are used which contain one or more oxyacids of sulfur in which the sulfur has an oxidation number from +5 to +1. The phosphatizing of the resulting zinc coatings results in phosphate coatings which are virtually free of spots. Suitable oxyacids are sulfurous acid ($H_2SO_3$), sulfoxylic acid ($H_2SO_2$), hyposulfurous acid ($H_2S_2O_4$) and/or thiosulfuric acid ($H_2S_2O_3$) in the form of acids, salts and acid anhydrides. The oxyacids should be present in the electrolyte in a concentration of 0.05 to 10 g/l, preferably 0.1 to 2 g/l.

6 Claims, No Drawings

METHOD OF ELECTRODEPOSITING ZINC ON STEEL PRIOR TO PHOSPHATING

FIELD OF THE INVENTION

Our present invention relates to a method of electrodepositing zinc on steel using zinc-containing aqueous sulfuric acid electrolyte solutions.

BACKGROUND OF THE INVENTION

It is known to provide surfaces of steel with a coating of metallic zinc by connecting the steel article as the cathode in a zinc-containing aqueous sulfuric acid electrolyte. After galvanic zinc coating the steel surfaces exhibit a much higher resistance to corrosion when exposed to various open-air atmospheric conditions.

It has been found that when an application of paint and the like coating materials is also intended it is desirable to provide the zinc surfaces with a phosphate coating before such a coating or painting by a treatment with an aqueous acid phosphatizing solution. After this treatment the resulting paint-zinc composite coating has a much higher bond strength and resistance to corrosion than zinc which has been painted without a phosphatizing pretreatment.

The phosphatizing baths used to treat the zinc contain zinc and phosphate as components which influence the formation of the coting. In addition, the coating may be modified by the presence of other cations, such as nickel, copper, calcium, manganese and alkali metal.

To accelerate the formation of the coating it is known to use oxidizing agents, e.g., of the group consisting of nitrates, chlorates, nitrites, peroxides, organic nitro compounds.

Other additives which may be used include, inter alia, fluorides, chlorides, organic polyhydroxycarboxylic acids, complex phosphates and surfactants. The baths are used with dipping, spraying-dipping and spraying operations at temperatures of usually 30° to 70° C. and with treatment times of, 0.5 to 5 minutes (EP-OS No. 69 950).

When it is desired to phosphatize surfaces of electrodeposited zinc which are contaminated with films of oil, grease and fat, the phosphatizing must be preceded by a degreasing treatment, which is usually carried out with an aqueous alkaline solution. A water rinse is used between the degreasing and phosphatizing treatments.

The phosphatizing treatment is succeeded by a water rinse, which is usually followed by a passivating afterrinse.

The uniform phosphate coating formed by the phosphatizing of zinc-coated steel surfaces is often found to have small whitish spots, which in a microscopic examination are found to consist of crystals accumulated at the rims of pits.

As phosphatizing proceeds, the zinc surface in contact with the phosphatizing solution is virtually completely coated with a phosphate coating but, for reasons not known thus far, several spots which are 0.1 to 1 mm in diameter are left uncoated and subjected to a continued pickling action by the phosphatizing solution.

Owing to the large amount of zinc ions present at the pits, tertiary zinc phosphate is precipitated at the rims of the pits and is built up like a rim of a crater. After painting, the spots appear as small elevations in the paint film and require expensive grinding operations for their removal.

A local corrosion of the zinc surface may also be caused during the cleansing and rinsing processes. Particularly the cleansing results in an efflorescence of crystals in an extent of a few millimeters in a direction that is parallel to the surface.

The formation of spots during the cleansing and during the phosphatizing may be inhibited by the use of treating solutions having special compositions, but the need for such special compositions has previously imposed a restriction of the range in which the composition of the treating solutions can be varied and has rendered more difficult the achieving of an optimum which would be desirable with a view to other objects, such as the improvement of the bond strength of the paint and the resistance to corrosion. For this reason there is a demand for zinc-coated surfaces which exhibit no or fewer spots.

OBJECTS OF THE INVENTION

It is an object of the invention to provide for the electrodeposition of zinc a process which is free from the disadvantages mentioned hereinbefore and particularly does not involve a formation of the abovementioned spots during the subsequent treatment.

Another object is to provide a galvanic steel zinc-plating method which will yield a readily phosphated product with improved surface properties.

SUMMARY OF THE INVENTION

To accomplish these objects, in accordance with the invention, we carry out galvanic zinc coating by a method wherein the zinc is electrodeposited from a sulfuric acid containing electrolyte solution which also contains one or more oxyacids of sulfur in which the sulfur has an oxidation number from +5 to +1.

In that context, the oxidation number is the charge which an atom of sulfur in the molecule would have if the molecule consisted only of ions.

The term zinc-containing sulfuric acid electrolyte solution covers those electrolytes which have a pH value below 5 and in addition to zinc contain at least a substantial proportion of sulfate ions. Other anions which may be present are, e.g., chlorides, acetates, citrates and boric acid. Additional cations which may be present in the electrolyte consist, e.g., of ammonium, alkali, aluminum, iron, nickel, lead, antimony, tin, alkaline earths, and may be intentionally added to the electrolyte in order to influence its properties or may incidentally and unintentionally enter the electrolyte with the initial or make-up water or from the anodes or other sources.

The electrolyte solutions are used in most cases above room temperature and with cathode current densities of, e.g., 1 to 100 amperes/dm$^2$. The electrolysis is usually continued until a zinc coating in a thickness between 2 and 15 micrometers has been formed. The process is usually carried out as a continuous process for the zinc coating of steel strip but can also be used to treat material contained in a drum or held on a rack.

The zinc coating is succeeded by a water rinse, and, as a rule, by an aftertreatment with suitable agents, such as aqueous oil emulsions, in order to inhibit a formation of white rust during storage and transportation. Zinc coted strip is often slightly rerolled in order to form a smoother surface and/or to improve its drawing properties. Phosphatization can also be carried out in the manner described.

The oxyacids of monovalent to pentavalent sulfur which are employed in the process in accordance with the invention may be supplied to the electrolyte in the form of the acids, the salts or the acid anhydrides.

In a preferred embodiment of the invention, the oxyacid of sulfur contained the zinc-depositing electrolyte solution consists of sulfurous acid ($H_2SO_3$; oxidation number 4); sulfoxylic acid ($H_2SO_2$; oxidation number 2), hyposulfurous acid ($H_2S_2O_4$; oxidation number 3) and/or thiosulfuric acid ($H_2S_2O_3$; oxidation number 2) or the corresponding salts or anhydrides.

The concentration of the oxyacids of sulfur should have a value between 0.05 and 10 g/l, preferably between 0.1 and 2.0 g/l, but in any event sufficient to reduce the surface pitting and spot formation over that in the absence.

The invention will be explained more in detail and by way of example with reference to the following Examples.

EXAMPLES

Bright, greasefree, sheet metal steel strips for deep drawing were treated in the following general procedure:

(1) Pickling; 10 wt.% $H_2SO_4$, 5 g/l Fe (II) as sulfate, 5 g/l Fe (III) as sulfate, 3 seconds dipping at room temperature;

(2) Rinsing with water and squeegeeing;

(3) Electrodeposition of zinc from an electrolyte solution containing:

120 g/l Zn as $ZnSO_4.7H_2O$, chemically pure
4 g/l $H_2SO_4$ (100 wt.%)
0.3 g/l Fe(II) as sulfate
0.2 g/l Fe (III) as sulfate
and additives, if desired.

The electrolyte solution is used at 55° C. with slight stirring and at a cathode current density of 20 amperes/dm$^2$ and with counterelectrodes consisting of high-purity zinc anodes. The electrolysis was continued for 80 seconds.

(4) Rinsing with water;

(5) Rinsing with entirely desalted water and squeegeeing;

(6) Drying.

After this electrodeposition of zinc, the sheet metal elements were subjected to the following further processing:

(7) Alkaline cleaning with a cleaner containing 6.9 g/l $Na_2B_4O_7.10H_2O$
2.3 g/l $Na_2SiO_3.5H_2O$
1.5 g/l $Na_5P_3O_{10}$
1.5 g/l $Na_4P_2O_7$
1.5 g/l $Na_3PO_4$
1.4 g/l surfactant
at 60° C. by an immersion for 5 minutes;

(8) Rinsing with water;

(9) An activating prerinse with a dispersion containing 2 g/l of a mixture of titanium phosphate and disodiumphosphate at 40° C. by an immersion for 1 minute;

(10) Phosphating with a phosphating solution which contains 1.51 g/l Zn
1.00 g/l Ni
4.80 g/l Na
16.08 g/l $P_2O_5$
3.06 g/l $ClO_3$
2.19 g/l $NO_3$
0.40 g/l Cl
0.6 g/l Na-m-nitrobenzene sulfonate and which has about 1.8 points of free acid (corresponding to a consumption of about 1.8 ml N/10 NaOH by a titration of a bath sample of 10 ml against dimethyl yellow) and about 28 points of total acid (corresponding to a consumption of about 28 ml N/10 NaOH by a titration of a bath sample of 10 ml against phenolphthalein). The treatment is effected at 60° C. by an immersion for 5 minutes.

(11) Rinsing with water;

(12) Rinsing with entirely desalted water;

(13) Drying.

Sodium thiosulfate, sodium sulfite, sodium hyposulfite, and sodiumformaldehyde sulfoxylate in different quantities were added to the zinc-containing electrolyte solution used in process step 3. The quantity and nature of the addition are listed in the following Table, in which the test results are also compiled.

TABLE

| Additive in zinc deposition bath | Appearance of zinc layer | Thickness of zinc layer μm | Number of spots in phosphate coating |
|---|---|---|---|
| No | silver-gray | 6 to 8 | medium |
| $Na_2S_2O_3$ | | | |
| 0.1 g/l | silver-light gray | 7 to 8 | very few |
| 0.3 g/l | light gray | 6 to 8 | none |
| 1.0 g/l | medium gray | 6 to 8 | none |
| 3.0 g/l | medium gray | 7 to 9 | none |
| 10.0 g/l | dark gray | 7 to 9 | none |
| $Na_2SO_3$ | | | |
| 0.3 g/l | light gray | 6 to 8 | none |
| 1.0 g/l | medium gray | 6 to 8 | none |
| 3.0 g/l | dark gray | 7 to 8 | none |
| 10.0 g/l | dark gray | 7 to 9 | none |
| $Na_2S_2O_4$ | | | |
| 0.3 g/l | light gray | 6 to 8 | none |
| 1.0 g/l | medium gray | 6 to 8 | none |
| 3.0 g/l | medium gray | 6 to 8 | none |
| 10.0 g/l | dark gray | 7 to 9 | none |
| Na—formaldehyde sulfoxylate | | | |
| 0.3 g/l | silver-gray | 6 to 8 | large |
| 1.0 g/l | light gray | 6 to 7 | few |
| 3.0 g/l | light gray | 5 to 7 | very few |
| 10.0 g/l | light gray | 6 to 8 | none |

From the test results it is apparent that the electrodeosition of zinc in the presence of oxyacids of sulfur in which the sulfur has an oxidation number from +5 to +1 results in the formation of zinc layers which can be phosphated virtually without a formation of spots. This result can be produced by the use of inorganic oxyacids even in very small quantities. Only sodiumformaldehyde sulfoxylate must be added to the electrolyte in somewhat larger quantities.

We claim:

1. In a process for electrodepositing zinc on steel by means of zinc-containing aqueous sulfuric acid electrolyte solutions and then applying a phosphate coating to the zinc-coated steel the improvement wherein the zinc is electrodeposited from an electrolyte solution which contains one or more oxyacids os sulfur in which the sulfur has an oxidation number from +5 to +1 in an amount sufficient to substantially prevent spot formation.

2. The improvement defined in claim 1 wherein the oxyacid of sulfur contained in the electrolyte solution is selected from the group which consists of sulfurous acid ($H_2SO_3$; oxidation number 4); sulfoxylic acid ($H_2SO_2$; oxidation number 2), hyposulfurous acid ($H_2S_2O_4$; oxidation number 3) and thiosulfuric acid ($H_2S_2O_3$; oxidation number 2), their salts and anhydrides, and mixtures thereof.

3. The improvement defined in claim 2 wherein said oxyacid is present in an amount of 0.05 to 10 g/l in said solution.

4. The improvement defined in claim 3 wherein said amount of 0.1 to 2 g/l of said solution.

5. A process for treating a steel object which comprises the steps of:

(a) pickling at least a surface of said object;

(b) electrodepositing zinc on said surface from a zinc-containing sulfuric acid electrolyte solution to form a zinc coating on said surface;

(c) limiting pitting of said coating by adding to said solution at least one oxyacid of sulfur in which sulfur has an oxidation number of +5 to +1 in an amount of 0.05 to 10 g/l of said solution and sufficient to limit pitting; and (d) phosphatizing the resulting zinc coating to form a phosphate coating on the zinc which is substantially free from spots.

6. The process defining claim 5 wherein said oxyacid of sulfur is selected from the group which consists of $H_2SO_3$, $H_2SO_2$, $H_2S_2O_4$ and $H_2S_2O_3$ and said amount is 0.1 to 2 g/l of said solution.

* * * * *